US012529485B2

(12) United States Patent
Mhamane et al.

(10) Patent No.: US 12,529,485 B2
(45) Date of Patent: Jan. 20, 2026

(54) FAN ASSEMBLY FOR HVAC SYSTEM

(71) Applicant: Johnson Controls Tyco IP Holdings LLP, Milwaukee, WI (US)

(72) Inventors: Shripad Ambadas Mhamane, Pune (IN); Naushad Parapurath Monangat, Pune (IN); Karan Garg, Pune (IN); Nitin Arvind Kurane, Kolhapur (IN); Sumit Kumar Singh, Pune (IN); Anil Kumar Vishwakarma, Pune (IN); Sumedh J. Suryawanshi, Pune (IN); Praveen M. Gotakhindi, Pune (IN)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 218 days.

(21) Appl. No.: 18/094,640

(22) Filed: Jan. 9, 2023

(65) Prior Publication Data

US 2024/0230114 A1 Jul. 11, 2024

(51) Int. Cl.
*F24F 1/38* (2011.01)
*F24F 13/20* (2006.01)

(52) U.S. Cl.
CPC ..... *F24F 1/38* (2013.01); *F24F 13/20* (2013.01); *F24F 2013/205* (2013.01); *F24F 2221/16* (2013.01)

(58) Field of Classification Search
None
See application file for complete search history.

(56) References Cited

U.S. PATENT DOCUMENTS

| | | | | |
|---|---|---|---|---|
| 3,665,727 | A * | 5/1972 | Mather | F24F 1/0323 62/262 |
| 4,130,376 | A * | 12/1978 | Dietsche | F04D 29/424 312/334.44 |
| 7,108,478 | B2 * | 9/2006 | Hancock | F24F 1/0022 415/206 |
| 9,482,241 | B2 * | 11/2016 | Locker, Jr. | F04D 29/626 |
| 9,506,661 | B2 * | 11/2016 | Yamada | F24F 13/20 |
| 10,138,901 | B2 * | 11/2018 | Benson | F04D 25/166 |
| 11,906,196 | B2 * | 2/2024 | Diehl | F04D 17/16 |
| 2010/0041327 | A1 * | 2/2010 | Desler | F24F 1/0053 454/184 |
| 2014/0356168 | A1 * | 12/2014 | Cocks | F01D 5/141 29/889.7 |
| 2019/0353387 | A1 * | 11/2019 | Gupte | F24F 1/0063 |
| 2022/0341669 | A1 * | 10/2022 | Hachiya | H05K 7/20745 |

* cited by examiner

*Primary Examiner* — Kayla Mccaffrey
(74) *Attorney, Agent, or Firm* — Fletcher Yoder, PC

(57) ABSTRACT

A heating, ventilation, and/or air conditioning (HVAC) system includes a fan deck and an enclosure cooperatively defining a track, a fan configured to direct air flow through the HVAC system, and a mount positioned in engagement with the track and in the enclosure. The mount is coupled to the fan and is configured to move along the track, thereby adjusting a position of the fan in the enclosure.

17 Claims, 13 Drawing Sheets

FAN ASSEMBLY FOR HVAC SYSTEM

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties by conditioning an air flow delivered to the environment. For example, the HVAC system may place the air flow in a heat exchange relationship with a working fluid directed through the HVAC system to condition the air flow. The HVAC system may include a fan configured to direct the air flow through the HVAC system, such as across a heat exchanger through which the working fluid is directed.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system includes a fan deck and an enclosure cooperatively defining a track, a fan configured to direct air flow through the HVAC system, and a mount positioned in engagement with the track and in the enclosure. The mount is coupled to the fan and is configured to move along the track, thereby adjusting a position of the fan in the enclosure.

In one embodiment, a fan section of a heating, ventilation, and/or air conditioning (HVAC) system includes a fan assembly comprising a plate and a fan coupled to the plate, an enclosure comprising a panel, and a fan deck having a bracket. The plate of the fan assembly engages with the bracket of the fan deck and the panel of the enclosure in an installed configuration of the fan assembly.

In one embodiment, a heating, ventilation, and/or air conditioning (HVAC) system includes a fan deck, an enclosure comprising a panel coupled to the fan deck, and a fan assembly comprising a mount and a fan coupled to the mount. The mount is configured to engage with the fan deck and the panel of the enclosure in an installed configuration of the fan assembly, and the mount is configured to slide along the fan deck and the enclosure.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
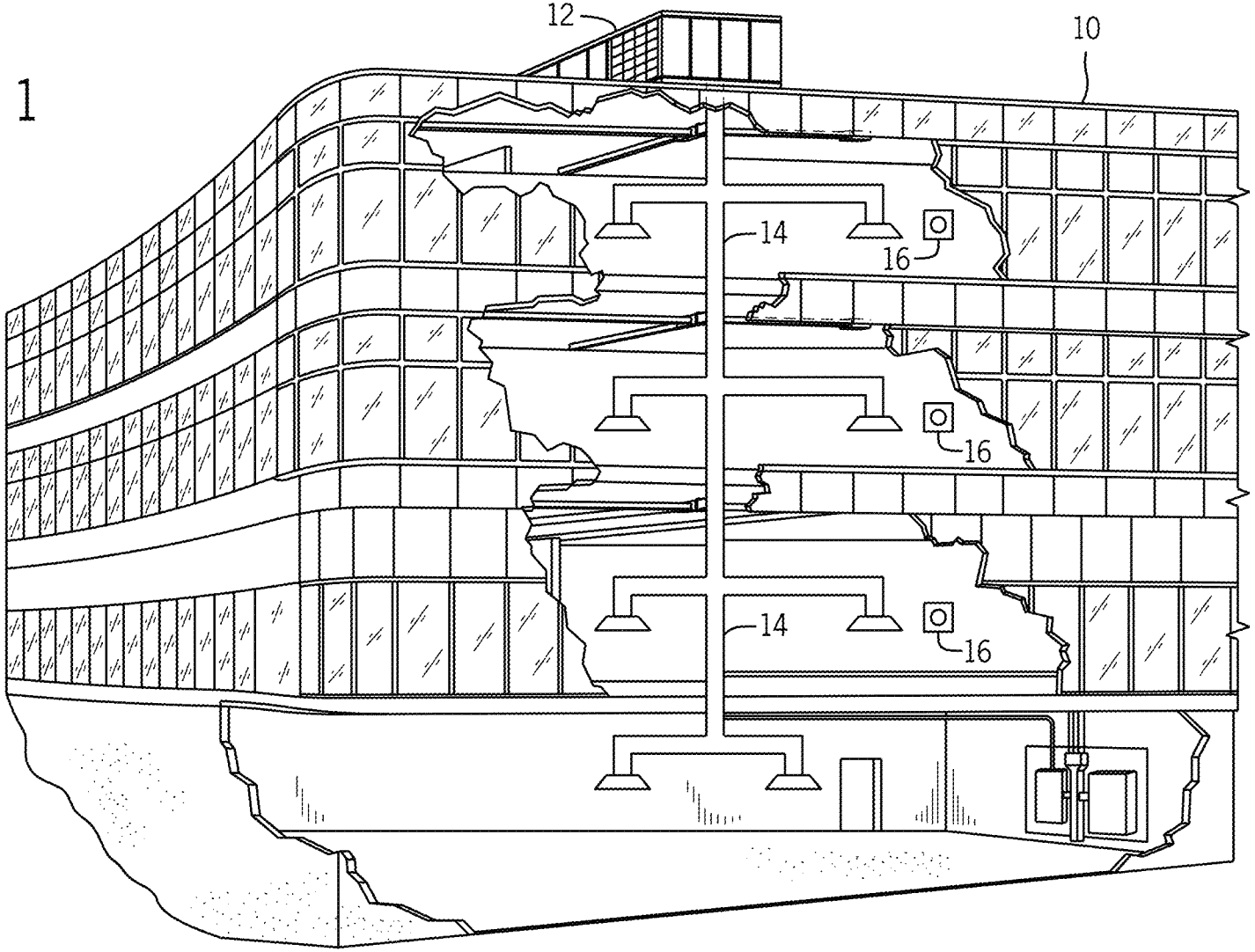
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

As used herein, the terms "approximately," "generally," "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to convey that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to convey that the given feature is within +/−5%, within +/−4%, within +/−3%, within +/−2%, within +/−1%, or even closer, to having the described nature, such as being parallel to another feature, being perpendicular to another feature, and so forth. Mathematical terms, such as "parallel" and "perpendicular," should not be rigidly interpreted in a strict mathematical sense, but should instead be interpreted as one of ordinary skill in the art would interpret such terms. For example, one of ordinary skill in the art would understand that two lines that are substantially parallel to each other are parallel to a substantial degree, but may have minor deviation from exactly parallel.

The present disclosure is directed to a heating, ventilation, and/or air conditioning (HVAC) system. The HVAC system may operate to condition an air flow and deliver the conditioned air flow to a space to condition the space. For example, the HVAC system may include a heat exchanger through which a working fluid (e.g., combustion products, a refrigerant) may be directed. The air flow may be directed across the heat exchanger to condition (e.g., heat, cool, dehumidify) the air flow. The air flow may then be directed to the space to condition the space.

The HVAC system may include a fan configured to direct the air flow through the HVAC system, such as across the heat exchanger. It may be desirable to improve an arrangement and/or operation of the fan. As an example, it may be desirable to reduce a difficulty and/or complexity associated with performing an installation operation, an inspection operation, a maintenance operation, a replacement operation, and so forth associated with the fan. As another example, it may be desirable to reduce power consumption and/or increase a flow rate of air directed by the fan during operation of the fan.

Thus, it is presently recognized that an improved arrangement of the fan may provide benefits associated with the HVAC system, such as for installing, operating, and/or maintaining the HVAC system. Accordingly, embodiments of the present disclosure are directed to a fan section having a direct drive fan that may be easily inserted into and/or removed from the fan section. For example, the direct drive fan may include an impeller and a motor that are directly coupled to one another. The motor may operate to rotate the impeller. The direct coupling between the impeller and the motor may limit components (e.g., intermediate couplings) that would otherwise be used to transfer power provided by the motor to cause rotation of the impeller, thereby reducing efficiency loss associated with power transfer from the motor to the impeller, reducing a complexity associated with assembly between the impeller and the motor, and/or reducing a cost associated with manufacture, installation, inspection maintenance, and/or replacement of the fan assembly. The direct drive fan may be coupled to a mount, which may be movable along a track defined by the fan section. For instance, the fan section may include an enclosure and a fan deck that cooperatively define the track, and the enclosure and the fan deck may capture the mount positioned in engagement with the track. The mount may be moved (e.g., translated) along the enclosure and the fan deck to enable the fan coupled to the mount to be inserted into the fan section and/or removed from the fan section. Such movement of the fan may facilitate ease of installation, inspection, maintenance, and/or replacement of the fan.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 maybe a commercial structure or a residential structure. As shown, the HVAC unit 12 is disposed on the roof of the building 10; however, the HVAC unit 12 maybe located in other equipment rooms or areas adjacent the building 10. The HVAC unit 12 maybe a single package unit containing other equipment, such as a blower, integrated air handler, and/or auxiliary heating unit. In other embodiments, the HVAC unit 12 maybe part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 maybe a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 maybe used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
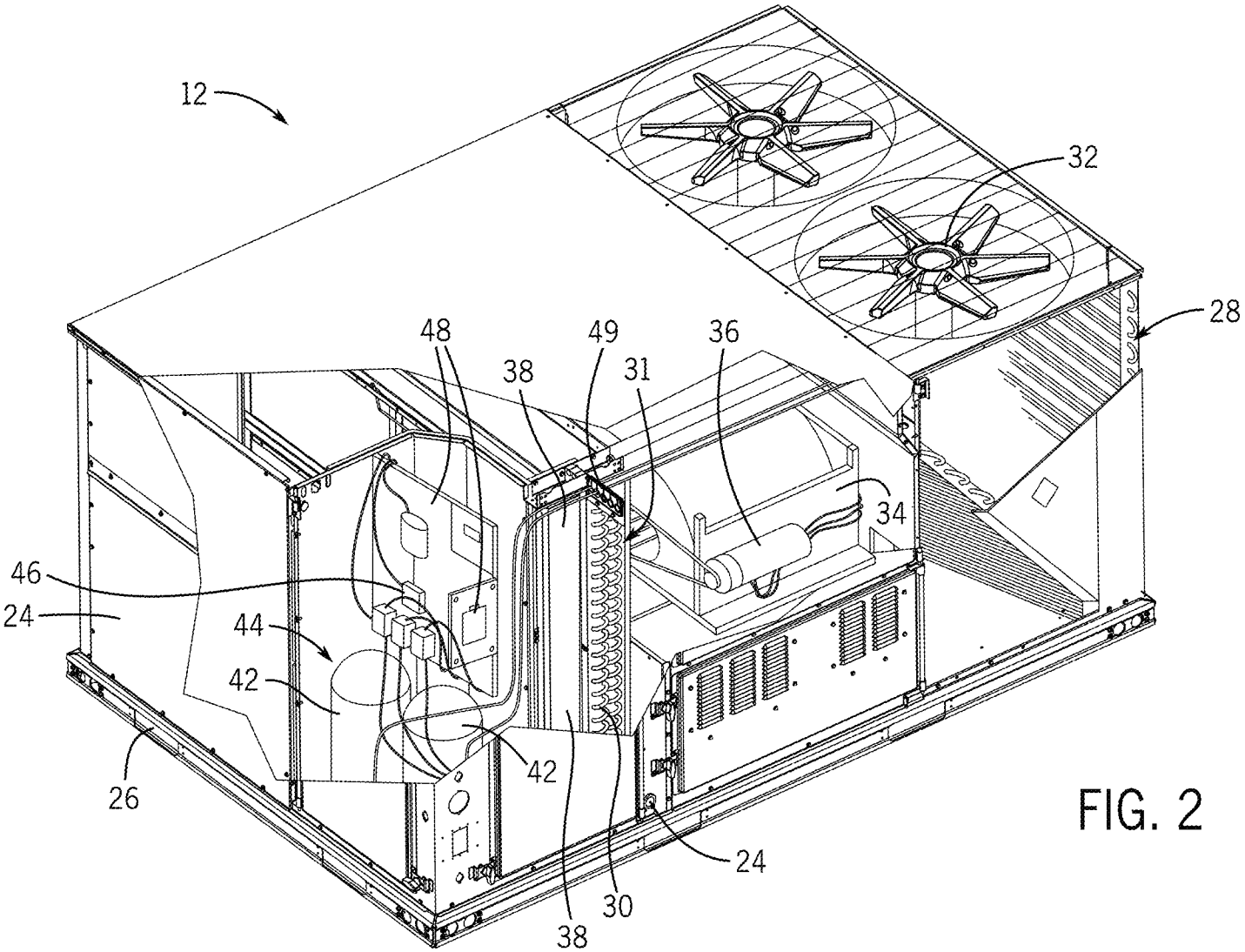
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 maybe constructed of galvanized steel and insulated with aluminum foil faced insulation. Rails 26 maybe joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 maybe reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 maybe disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 maybe any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 maybe governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
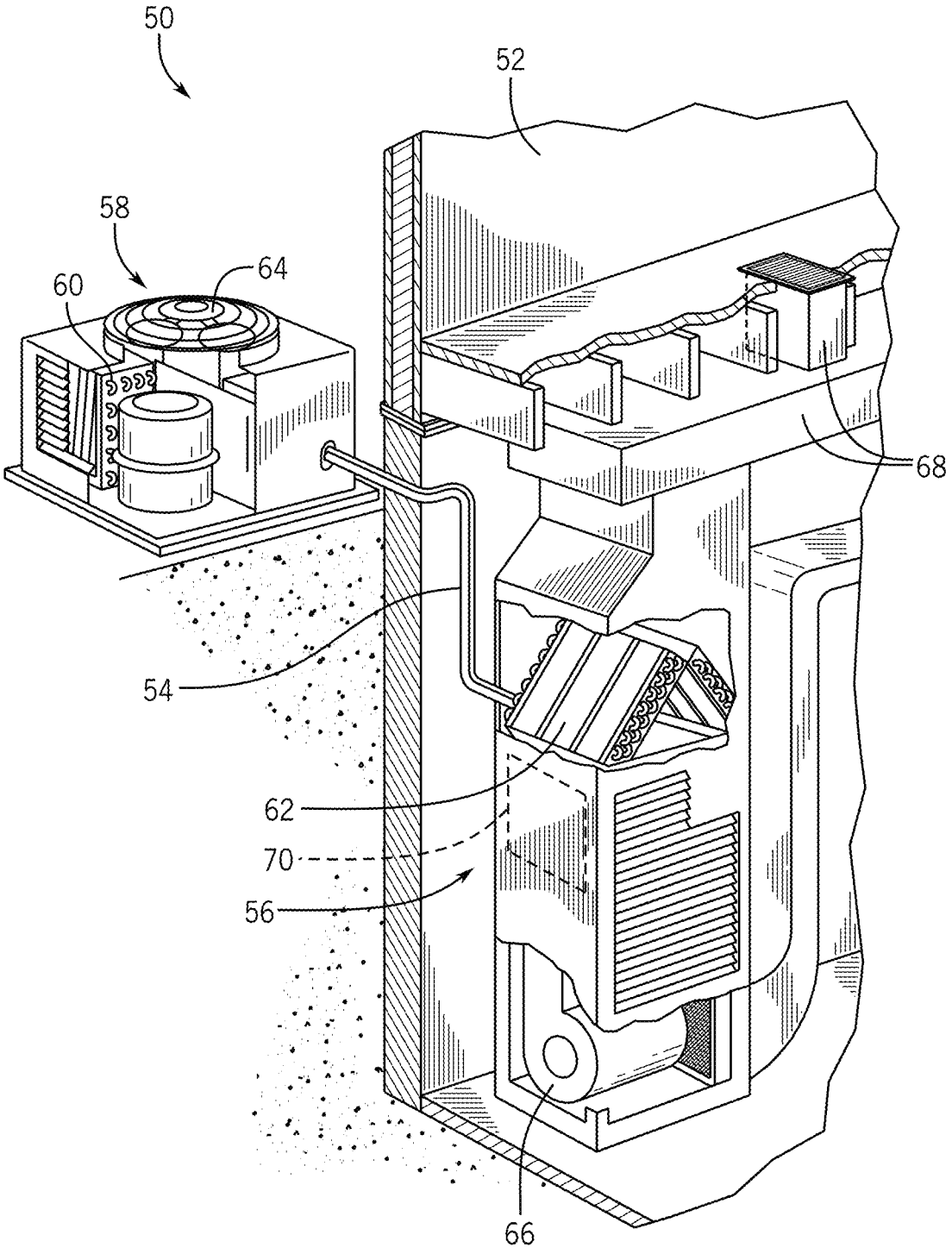
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 maybe positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
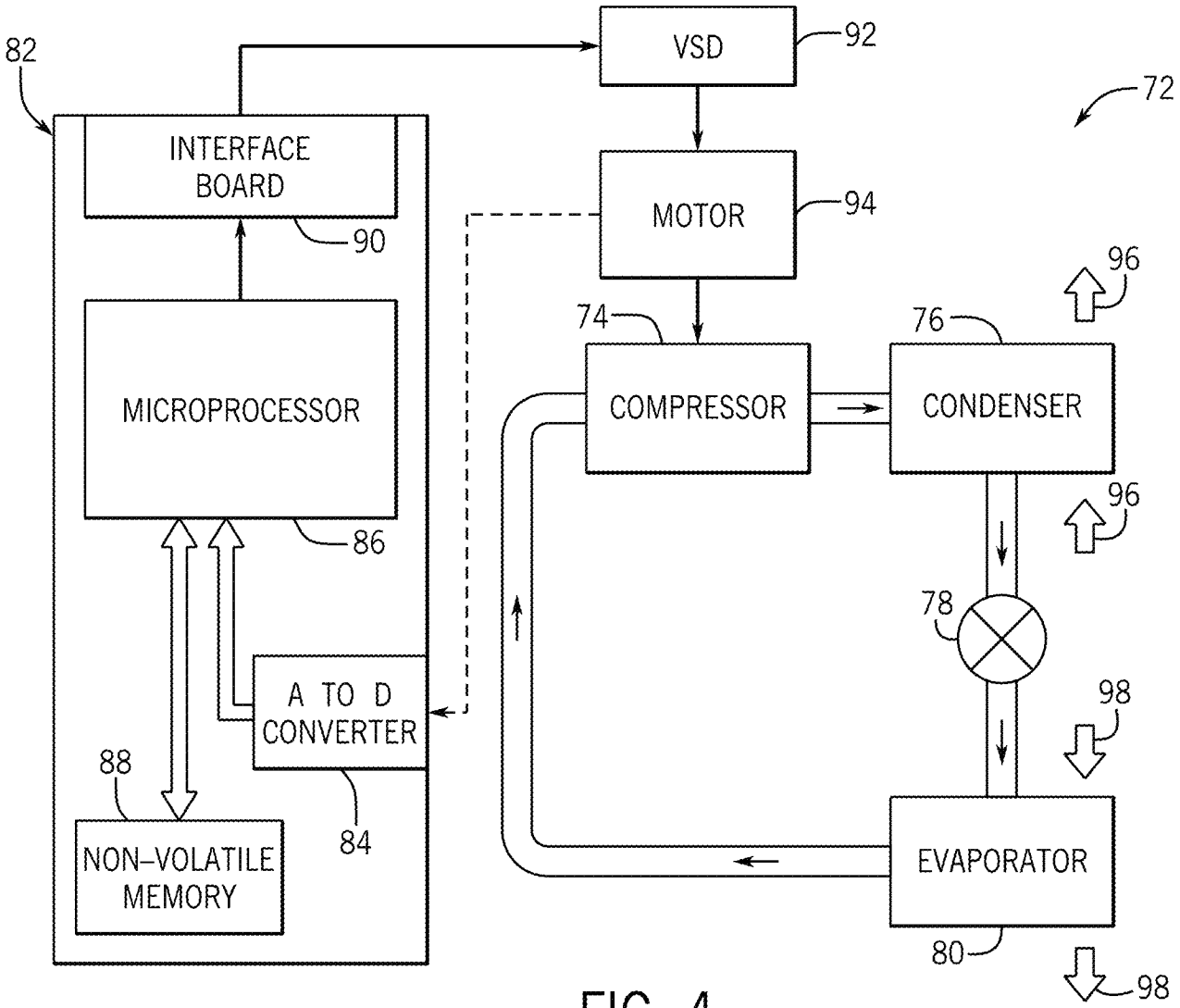
FIG. 4 is a schematic diagram of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80.

The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 maybe a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to a fan assembly for an HVAC system. The HVAC system may include a fan section in which the fan assembly may be positioned. The fan assembly may include a direct drive fan to provide benefits of reduced cost and/or complexity, increased efficiency and/or performance, and/or improved ease of installation, maintenance, inspection, and/or replacement associated with the fan assembly. The direct drive fan may be coupled to a mount. The mount may be easily positioned in engagement with and/or removed from engagement with a track defined by the fan section to provide ease of adjustment of the fan assembly with respect to the fan section, such as to implement the fan assembly into the fan section and/or to remove the fan assembly from the fan section.

Figure 5:
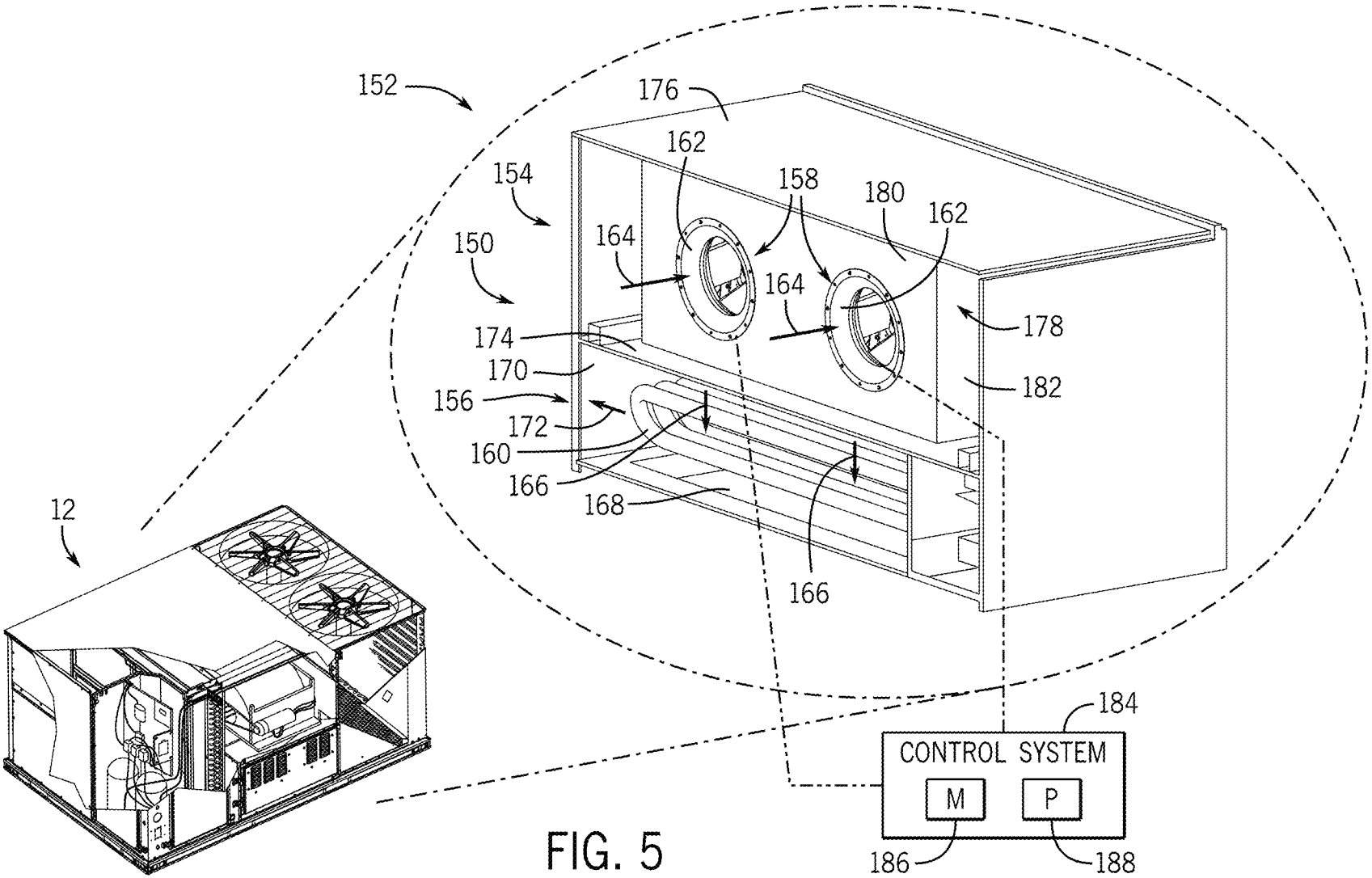
FIG. 5 is a side perspective view of an embodiment of an HVAC system having a fan section configured to direct an air flow through the HVAC system, in accordance with an aspect of the present disclosure.

With this in mind, FIG. 5 is a side perspective view of an embodiment of a portion 150 of an HVAC system 152 (e.g., the HVAC unit 12). The portion 150 of the HVAC system 152 includes a fan section 154 and a heat exchange section 156. The fan section 154 may include one or more fans 158, and the heat exchange section 156 may include a heat exchanger 160 (e.g., heat exchange coils). The fans 158 may direct an air flow across the heat exchanger 160 to place the air flow in a heat exchange relationship with a working fluid directed through the heat exchanger 160. In some embodiments, the air flow may absorb heat from the working fluid (e.g., combustion products), thereby increasing a temperature of the air flow. In additional or alternative embodiments, the working fluid (e.g., a refrigerant, a cooling fluid) may absorb heat from the air flow, thereby reducing a temperature of the air flow.

By way of example, each of the fans 158 may include a respective inlet 162 through which the air flow may be directed (e.g., drawn) in a first direction 164 to enter the fan section 154. Each fan 158 may then direct (e.g., force) the air flow in a second direction 166 from the fan section 154, to the heat exchange section 156, and across the heat exchanger 160. The second direction 166 may be oriented crosswise (e.g., perpendicularly) to the first direction 164. To this end, each fan 158 may be a radial fan or a centrifugal fan configured to receive the air flow in the first direction 164 and discharge the air flow in the second direction 166. The heat exchange section 156 may discharge the air flow directed across the heat exchanger 160 into a space fluidly coupled to the HVAC system 152. As such, the air flow discharged from the heat exchange section 156 may condition the space.

In certain embodiments, the heat exchange section 156 may include a first discharge opening 168 through which the air flow may be directed in the second direction 166 for discharge from the heat exchange section 156. As such, the fans 158 may direct the air flow in the second direction 166 across the heat exchanger 160 and out of the heat exchange section 156 via the first discharge opening 168. In additional or alternative embodiments, the heat exchange section 156 may include a second discharge opening 170, and the air flow may be directed in a third direction 172 for discharge from the heat exchange section 156 via the second discharge opening 170. In this manner, the fans 158 may receive the air flow in the first direction 164, direct the air flow in the second direction 166 across the heat exchanger 160, and direct the air flow in the third direction 172 out of the heat exchange section 156 via the second discharge opening 170. The heat exchange section 156 may deliver air flow into the space conditioned by the HVAC system 152 via the first discharge opening 168 and/or the second discharge opening 170. For example, ductwork may fluidly couple the first discharge opening 168 and/or the second discharge opening 170 to the space to enable the air flow discharged by the heat exchange section 156 to flow to the space via the ductwork.

Although the fans 158 are configured to direct the air flow into the heat exchange section 156, across the heat exchanger 160, and out of the HVAC system 152 in the illustrated embodiment, it should be noted that the fans 158 may be configured to direct the air flow in any other suitable manner in additional or alternative embodiments. For example, the fans 158 may discharge air flow from the space conditioned by the HVAC system 152 to an external environment, direct air flow from the external environment into the space without conditioning the air flow via any heat exchanger, and so forth.

The fan section 154 may include a fan deck 174 that may separate the fan section 154 and the heat exchange section 156 from one another. The fan section 154 may also include a cover 176 that may separate the fan section 154 from another portion of the HVAC system 152, such as another heat exchange section. The fan section 154 may also include an enclosure 178 in which the fans 158 may be positioned to secure a position of the fans 158. For example, the enclosure 178 may include an inlet panel 180 and/or side panels 182. The inlet panel 180 and the side panels 182 may be configured to couple to one another, to the fan deck 174, and/or to the cover 176 and may define a volume of the enclosure 178. The fans 158 may be positioned within the volume of the enclosure 178 such that the fan deck 174, the cover 176, the inlet panel 180, and the side panels 182 cooperatively enclose the fans 158. In some embodiments, an additional panel (e.g., a divider panel) may be positioned within the volume of the enclosure 178 to separate the respective air flows directed by the fans 158. For example, the additional panel may block the air flows from mixing and combining with one another and, instead, may facilitate directing of the air flow from the fan section 154 into the heat exchange section 156. The fans 158 may be configured to couple to the enclosure 178, such as to the inlet panel 180 and/or to the side panels 182, to secure a position of the fans 158 within the fan section 154. As discussed herein, in some embodiments, the arrangement of the fans 158 may enable a position of the fans 158 to be readily and individually adjusted, such as for removal from the fan section 154 and/or for installation within the fan section 154.

Each fan 158 may be operated by a control system 184 (e.g., a programmable controller, an automation controller, an electronic controller, control circuitry, a cloud computing system). The control system 184 may include a memory 186 and processing circuitry 188. The memory 186 may include a non-transitory computer-readable medium that may include volatile memory, such as random-access memory (RAM), and/or non-volatile memory, such as read-only memory (ROM), flash memory, optical drives, hard disc drives, solid-state drives, or any other suitable non-transitory computer-readable medium storing instructions that, when executed by the processing circuitry 188, may control operation of the fans 158. To this end, the processing circuitry 188 may include one or more application specific integrated circuits (ASICs), one or more field programmable gate arrays (FPGAs), one or more programmable logic devices (PLD), one or more programmable logic arrays (PLA), one or more general purpose processors, or any combination thereof configured to execute such instructions.

In some embodiments, operation of each fan 158 may be directly controlled by the control system 184. For example, each fan 158 may include a respective motor (e.g., an electronically commutated motor) that may have respective processing circuitry 188 to individually operate the fans 158. Indeed, the fans 158 may be direct drive fans having motors that are directly coupled to fan impellers of the fans 158 without intermediate coupling of additional components (e.g., a belt, sheave, pulley). Thus, operation of the motors via the respective processing circuitry 188 may directly drive rotation of the fan impellers to operate the fans 158. As such, efficiency losses that would otherwise be caused by transfer of movement and power from the motors, to intermediate components, and to the fan impellers to operate the fans 158 may be reduced. For this reason, power consumption associated with operation of the fans 158 may be reduced, and/or a flow rate of air directed by the fans 158 at a certain power level may be increased. Moreover, reducing the number of components used to operate the fans 158 may reduce a complexity associated with installation, inspection, maintenance, replacement, and so forth associated with the fans 158. Further still, reducing the number of components used to operate the fans 158 may reduce a physical footprint of the fans 158, thereby increasing efficient usage of space.

The control system 184 may additionally or alternatively include a central controller configured to drive operation of the fans 158. As an example, the central controller may be communicatively coupled to the respective controllers configured to directly operate the fans 158. The central controller may output control signals to adjust operation of the respective motors (e.g., by communicating with the respective processing circuitry 188 of the motors). Thus, the central controller may independently control operation of the motors, such as to separately adjust the speed of the motors. For instance, the central controller may cause each motor to be operated at a different speed.

Figure 6:
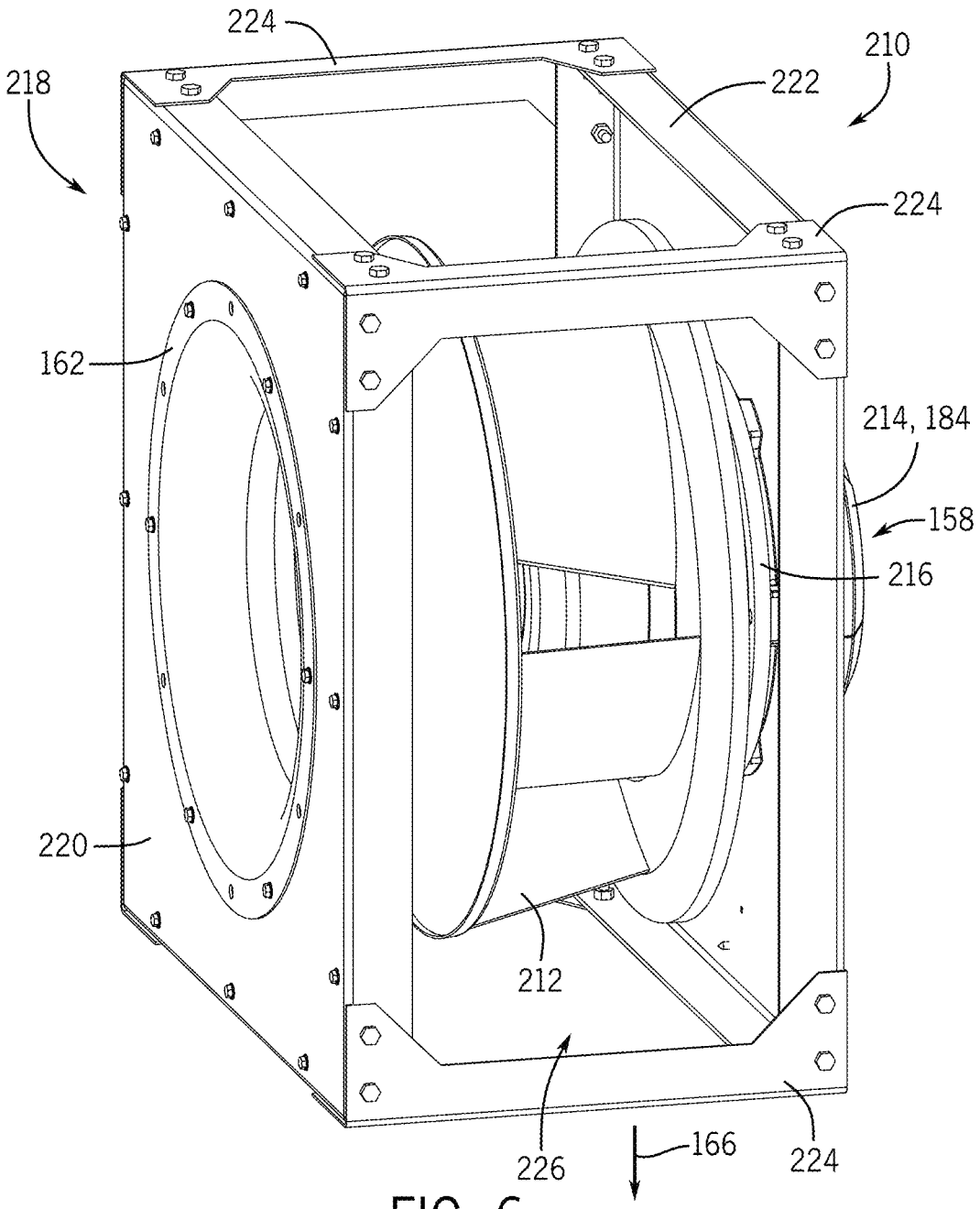
FIG. 6 is a side perspective view of an embodiment of a fan section configured to direct an air flow through an HVAC system, in accordance with an aspect of the present disclosure.

FIG. 6 is a side perspective view of an embodiment of a fan assembly 210 having the fan 158. In the illustrated embodiment, the fan 158 includes the inlet 162, an impeller 212 coupled to the inlet 162, and an electronic assembly 214 coupled to the impeller 212. The electronic assembly 214 may include the control system 184 (e.g., the processing circuitry 188) and a motor 216 that may be directly coupled to the impeller 212. During operation of the fan 158, the control system 184 may instruct the motor 216 (e.g., a shaft of the motor 216) to rotate. For example, the control system 184 may output a voltage to the motor 216, and the amount of voltage (e.g., between one and ten volts (V), between five and fifteen V, more than fifteen V) may cause the motor 216 to rotate at a particular speed. As such, the control system 184 may adjust the voltage being output to adjust the speed of the motor 216.

Rotation of the motor 216 may drive rotation of the impeller 212, and rotation of the impeller 212 may direct air flow through the fan assembly 210. In some embodiments, the impeller 212 may include blades having a backward curved configuration. That is, the blades of the impeller 212 may extend away from the direction (e.g., a tangential direction) in which the impeller 212 rotates during operation of the fan 158. The backward curved configuration may enable the fan 158 to achieve desirable efficiency during operation. As an example, the backward curved configuration may increase a speed of air flow to a desirable speed at high static pressure or high air resistance conditions within the fan section 154 without having to consume an excessive amount of power. Thus, the fan 158 may direct air flow in a desirable manner (e.g., at a threshold speed) while consuming limited power.

As discussed herein, the motor 216 and the impeller 212 may be directly coupled to one another to enable the motor 216 to directly drive rotation of the impeller 212. Direct coupling between the impeller 212 and the motor 216 may reduce energy losses associated with power transfer between the motor 216 and other intermediate components (e.g., a belt, a pulley, a sheave, a gear, a linkage) to drive rotation of the impeller 212. As such, the motor 216 may operate more efficiently, such as to more efficiently utilize power to drive rotation of the impeller 212. Furthermore, direct coupling between the impeller 212 and the motor 216 may improve different operations performed (e.g., manually performed) with respect to the fan assembly 210. By way of example, the fan assembly 210 may have fewer components to be installed, inspected, maintained, and so forth. Thus, the fan assembly 210 may be more easily and readily implemented and operated. Operation of the fan assembly 210 may also be relatively more reliable, because fewer components may be used to enable desirable operation of the fan assembly 210.

In some embodiments, each fan 158 implemented in the fan section 154 may be of the same model, size, or other specification. For example, each fan 158 may have the same configuration of the impeller 212 and/or of the motor 216. Thus, each fan 158 may generally direct the same rate of air flow. However, in additional or alternative embodiments, each fan 158 may be different from one another. For instance, each fan 158 may use a different configuration of the impeller 212 and/or of the motor 216 to direct different rates of air flow.

In certain embodiments, the electronic assembly 214 may be adjusted for the fan 158. That is, a first electronic assembly 214 (e.g., the motor 216, the control system 184) may be decoupled from the impeller 212, and a second electronic assembly 214 may be coupled to the impeller 212 to operate the fan 158. Thus, the electronic assembly 214 may be replaced without having to modify a remainder of the fan 158. Additionally or alternatively, the impeller 212 may be adjusted. That is, a first impeller 212 may be decoupled from the inlet 162 and from the electronic assembly 214, and a second impeller 212 may be coupled to the inlet 162 and to the electronic assembly 214 without having to modify a remainder of the fan 158. As such, specific components of the fan 158 may be adjusted to change a configuration of the fan 158.

The fan assembly 210 may also include a mount 218 configured to secure the fan 158 within the fan section 154. As an example, the mount 218 may include an inlet plate 220 (e.g., a front plate) configured to couple to the inlet 162 of the fan 158, such as via fasteners. The mount 218 may also include a motor plate 222 (e.g., a back plate) configured to couple to the electronic assembly 214 (e.g., to the motor 216), such as via fasteners. The mount 218 may further include intermediate supports 224 that are each coupled to the inlet plate 220 and to the motor plate 222. The intermediate supports 224 may block relative movement between the inlet plate 220 and the motor plate 222. In this way, the intermediate supports 224 may secure the fans 158 and the mount 218 to one another. For instance, the inlet plate 220, the motor plate 222, and the intermediate supports 224 may cooperatively capture the fan 158.

The inlet plate 220 and the motor plate 222 may also be offset from one another to define a space 226 that extends between the inlet plate 220 and the motor plate 222. A portion of the fan 158, such as the inlet 162, the impeller 212, and the motor 216, may be positioned within the space 226. The fan 158 may direct air flow through the space 226 in the second direction 166 for discharge from the fan assembly 210.

The inlet plate 220 may be configured to couple to the inlet panel 180 of the enclosure 178 in an installed configuration of the fan assembly 210. As such, the inlet plate 220 may secure the fan assembly 210 to the enclosure 178. Additionally, the inlet plate 220, the motor plate 222, and/or the intermediate supports 224 may engage with the fan deck 174 in the installed configuration. In this manner, the enclosure 178 and the fan deck 174 may cooperatively secure the fan assembly 210 within the fan section 154.

In the illustrated embodiment, the inlet plate 220 and the motor plate 222 are of approximately the same size. Therefore, the intermediate supports 224 may extend generally linearly from the inlet plate 220 to the motor plate 222. Additionally or alternatively, the inlet plate 220 and the motor plate 222 may be of different sizes. Furthermore, although each of the inlet plate 220 and the motor plate 222 has a rectangular configuration in the illustrated embodiment, the inlet plate 220 and/or the motor plate 222 may have any other suitable configuration (e.g., a circular configuration, a triangular configuration, an irregularly shaped configuration) in additional or alternative embodiments. The intermediate supports 224 may be oriented in any suitable manner (e.g., extend in a non-linear direction) to couple the inlet plate 220 and the motor plate 222 to one another.

Figure 7:
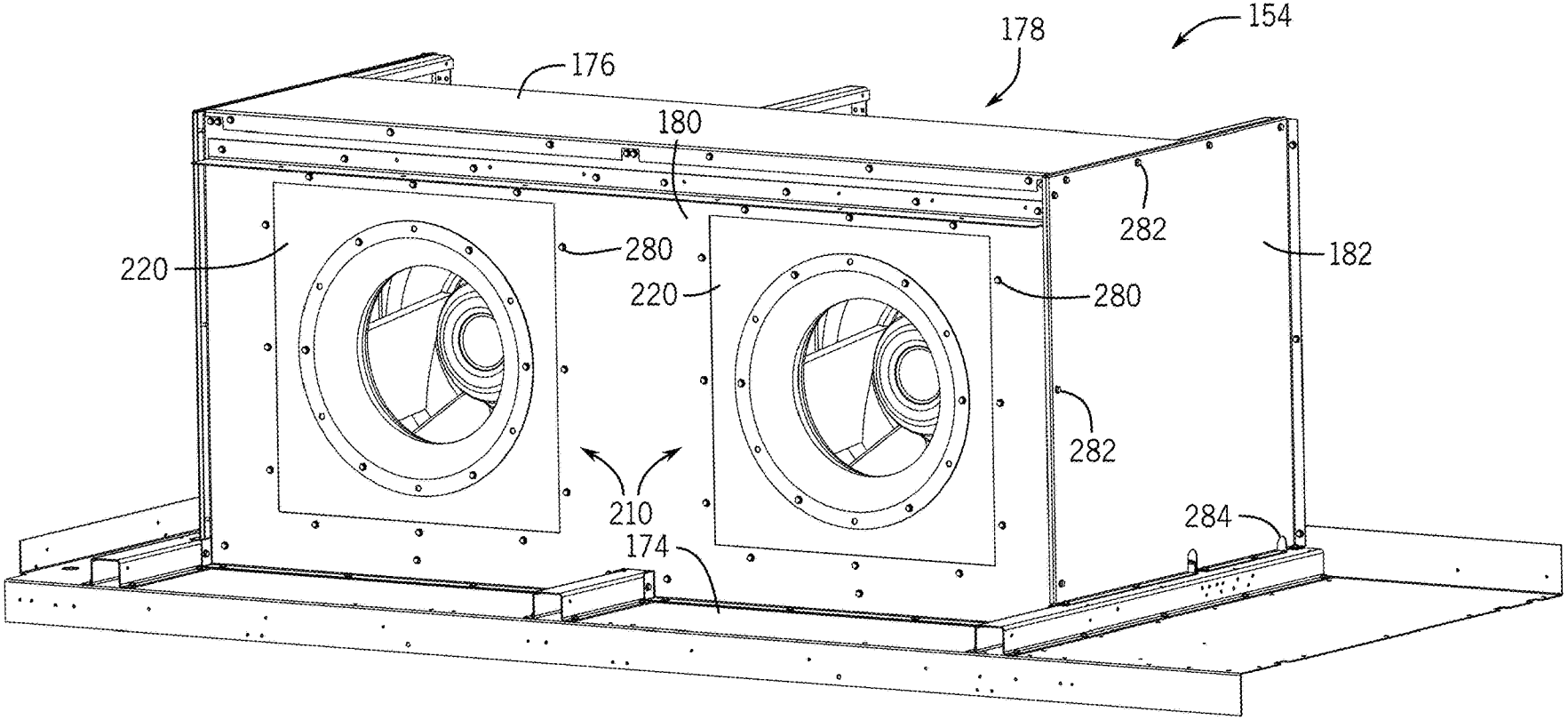
FIG. 7 is a front perspective view of an embodiment of a fan section of an HVAC system, in accordance with an aspect of the present disclosure.

FIG. 7 is a front perspective view of an embodiment of the fan section 154 of the HVAC system 152. The fan section 154 may include the fan assembly 210 in an installed configuration within the fan section 154. For example, the inlet plate 220 of each fan assembly 210 may be coupled to the inlet panel 180 of the enclosure 178 via first fasteners 280 to block relative movement between the fan assemblies 210 and the inlet panel 180. Additionally, the inlet panel 180 may be coupled to the fan deck 174 to block relative movement between the inlet panel 180 and the fan deck 174, thereby securing a position of the inlet panel 180 within the fan section 154. As such, relative movement between the fan assemblies 210 and the fan deck 174 may be blocked to secure a position of the fan assemblies 210 within the fan section 154. The fan assemblies 210 are positioned in a side-by-side arrangement in the illustrated embodiment. For example, each fan assembly 210 may be coupled to a surface of a common inlet panel 180, and the surface may extend in a planar direction. Thus, the fan assemblies 210 may be positioned adjacent to one another along a common plane. The fan assemblies 210 may be positioned in any other suitable arrangement in additional or alternative embodiments. By way of example, the fan assemblies 210 may be stacked vertically relative to one another, positioned diagonally from one another, positioned along different planes, and so forth. Indeed, in an example embodiment, the fan assemblies 210 may be coupled to different inlet panels 180.

Additionally, the side panels 182 may be coupled to the fan deck 174, the cover 176, and/or the inlet panel 180, such as via second fasteners 282 to secure the side panels 182 within the fan section 154. The side panels 182 may further secure the fan assemblies 210 within the enclosure 178. For example, the side panels 182 may enclose the fan assemblies 210 within the enclosure 178. Furthermore, the side panels 182 may shield the fan assemblies 210 from certain particles, such as dust and debris, thereby enabling desirable operation of the fan assemblies 210 and/or increasing a useful lifespan of the fan assemblies 210. In certain embodiments, the side panels 182 may include openings 284 that may enable electric conductors, such as a wire, a cable, and/or a bus bar, to pass through the side panels 182 into the enclosure 178. For example, the electric conductors may electrically couple the motors 216 and/or the control system 184 to a power source, a central control system, a transformer, and so forth to enable operation of the fan assemblies 210.

Figure 8:
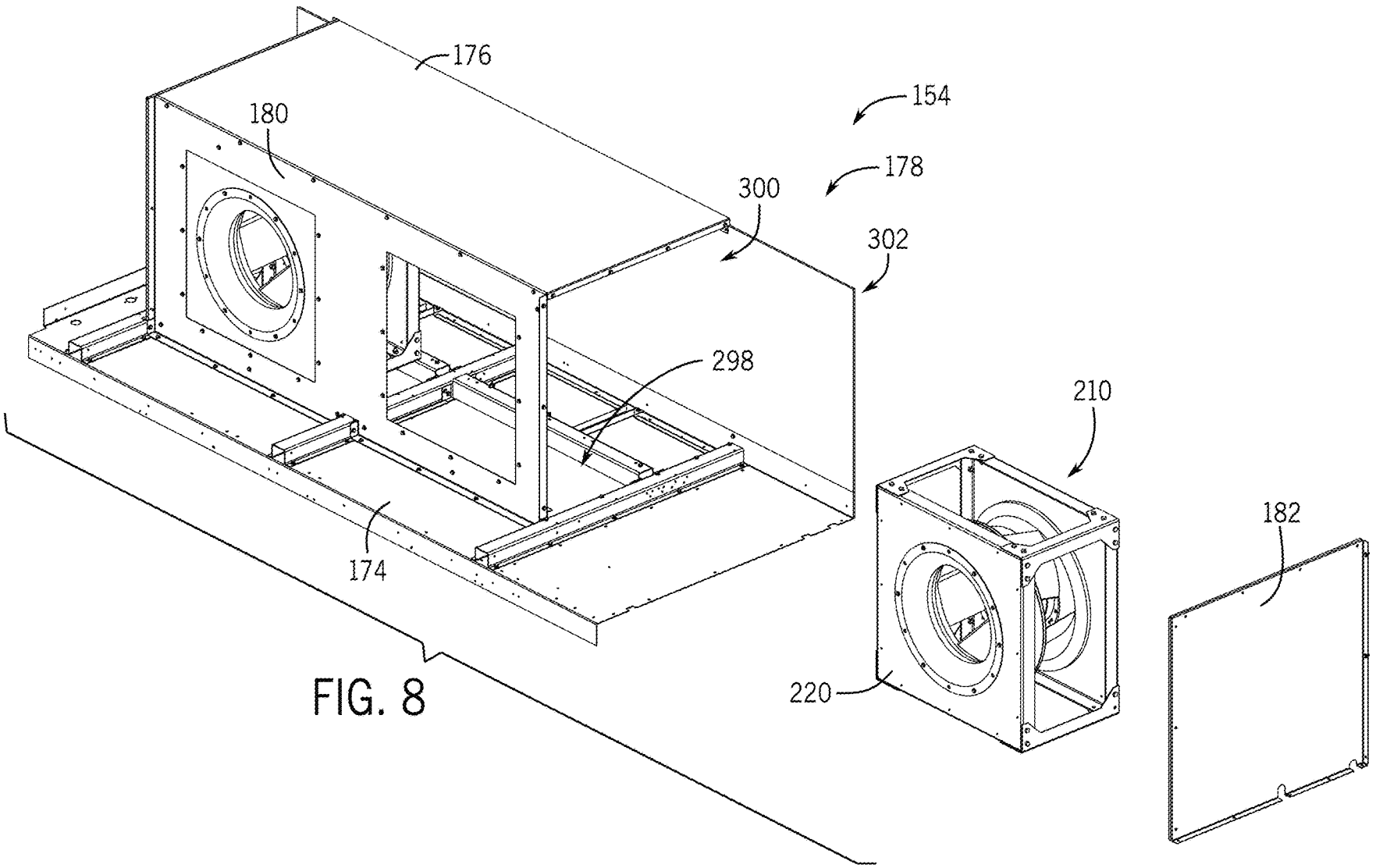
FIG. 8 is a front exploded perspective view of an embodiment of a fan section of an HVAC system with a fan assembly configured to move along a track of the fan section, in accordance with an aspect of the present disclosure.

FIG. 8 is a front exploded perspective view of an embodiment of the fan section 154. Each fan assembly 210 may be configured to move along the inlet panel 180 and/or the fan deck 174. For instance, the inlet panel 180 and/or the fan deck 174 may define a track 298 (e.g., a channel) along which a fan assembly 210 may move (e.g., translate). Each fan assembly 210 may move along the track 298 for insertion into a volume 300 defined by the enclosure 178 and/or for removal from the volume 300.

By way of example, to remove (e.g., manually remove) a fan assembly 210 from the enclosure 178, such as for maintenance and/or inspection, an adjacent side panel 182 may be decoupled from the fan deck 174, from the cover 176, and/or from the inlet panel 180 (e.g., by removing the second fasteners 282) to provide an opening 302 that exposes the fan assembly 210. In some embodiments, the adjacent side panel 182 may be coupled to one of the features (e.g., the fan deck 174, the cover 176, or the inlet panel 180) via a hinge and operable to latch to another of the features. This configuration may facilitate access to and securement of the fan assembly 210 within the enclosure 178. The inlet plate 220 of the fan assembly 210 may then be decoupled from the inlet panel 180 (e.g., by removing the first fasteners 280) to enable relative movement between the fan assembly 210 and the inlet panel 180. Decoupling the fan assembly 210 and the inlet panel 180 from one another may enable the fan assembly 210 to be moved along the track 298 defined by the inlet panel 180 and/or the fan deck 174, through the opening 302 created from removal of the side panel 182, and out of the enclosure 178. The fan assembly 210 may similarly be inserted (e.g., manually inserted) into the enclosure 178 by removing (e.g., opening about a hinge) the adjacent side panel 182 to provide the opening 302, inserting the fan assembly 210 into the enclosure 178 via the opening 302 created from removal of the side panel 182, positioning the fan assembly 210 in engagement with the track 298 defined by the inlet panel 180 and/or the fan deck 174, and coupling the fan assembly 210 and the inlet panel 180 to one another.

Each fan assembly 210 may be individually moved with respect to one another and may therefore be separately positioned within the enclosure 178 and/or removed from the enclosure 178. For example, one of the fan assemblies 210 may be removed from the enclosure 178 (e.g., by removing the adjacent side panel 182), while the positioning of another fan assembly 210 within the enclosure 178 may be maintained. Similarly, one of the fan assemblies 210 may be inserted into the enclosure 178 without having to insert another fan assembly 210 into the enclosure 178. Thus, various operations related to moving individual fan assemblies 210 may be more easily and readily performed.

Figure 9:
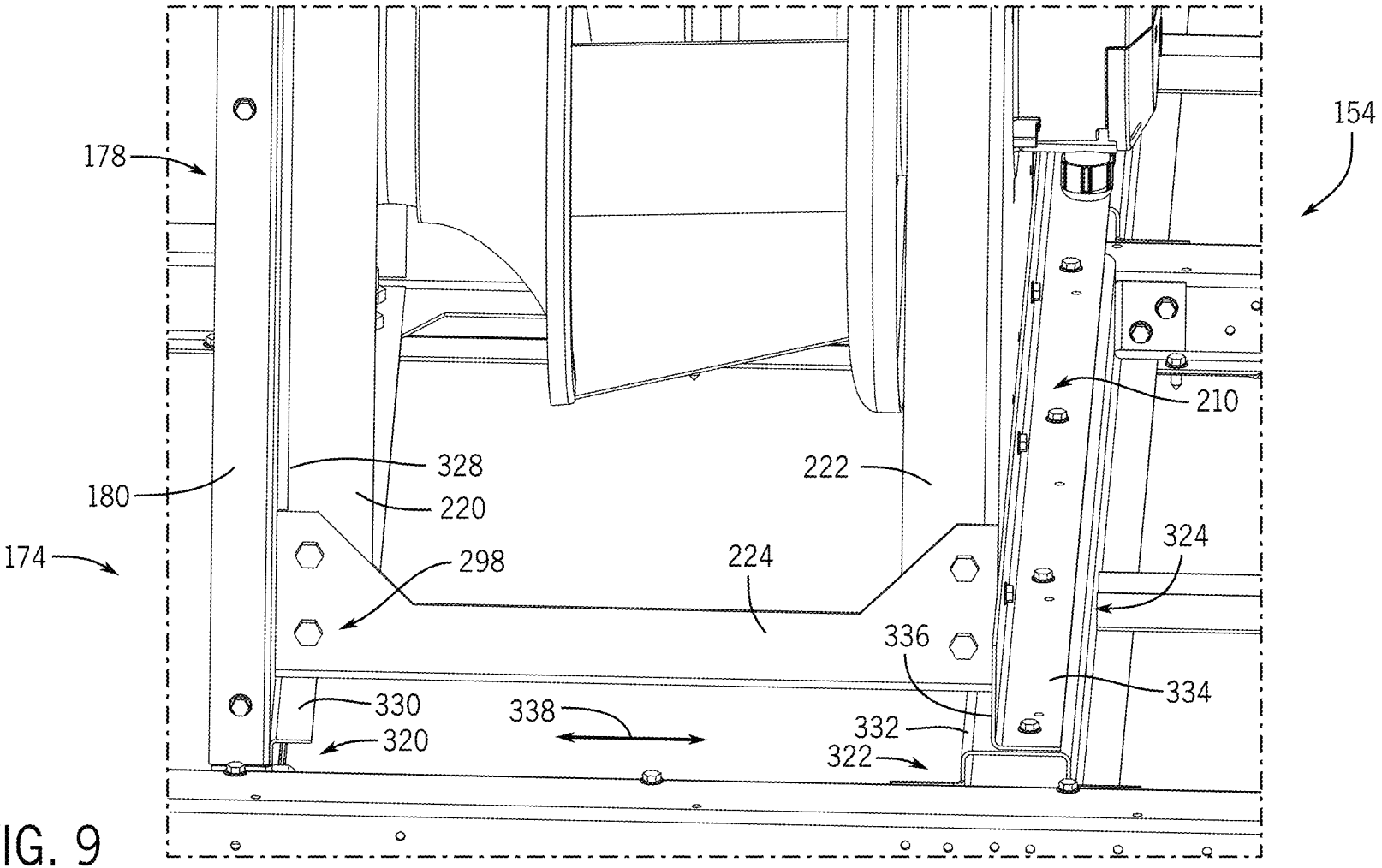
FIG. 9 is a side perspective view of an embodiment of a fan assembly configured to move along a track of a fan section of an HVAC system, in accordance with an aspect of the present disclosure.

FIG. 9 is a side perspective view of an embodiment of the fan section 154. Certain components of the fan section 154, such as the side panel 182, are not shown for visualization purposes. In the illustrated embodiment, the inlet panel 180 of the enclosure 178 is coupled to a first bracket 320 (e.g., a Z-shaped bracket) of the fan deck 174. Additionally, the fan deck 174 includes a second bracket 322 (e.g., a hat channel) and a third bracket 324 (e.g., an L-shaped bracket) coupled to one another. The inlet panel 180, the first bracket 320, the second bracket 322, and/or the third bracket 324 may define a track 298 in which the fan assembly 210 may be positioned. That is, the inlet panel 180, the first bracket 320, the second bracket 322, and/or the third bracket 324 may cooperatively capture the fan assembly 210 positioned in engagement with the track 298.

By way of example, the inlet panel 180 may include a surface 328 with which the inlet plate 220 and/or the intermediate supports 224 of the fan assembly 210 may engage. Additionally, the first bracket 320 may include a flange 330 that extends crosswise (e.g., perpendicularly) to the surface 328. The inlet plate 220 and/or the intermediate supports 224 may engage with the flange 330. For instance, the fan assembly 210 may be placed atop the flange 330 to enable the inlet plate 220 and/or the intermediate supports 224 to engage with the flange 330. Similarly, the second bracket 322 may include a base 332 with which the motor plate 222 and/or the intermediate supports 224 may engage with while the fan assembly 210 is placed atop the second bracket 322. The third bracket 324 may include a first segment 334 configured to couple to the base 332 of the second bracket 322. The third bracket 324 may also include a second segment 336 that extends crosswise (e.g., perpendicularly) relative to the first segment 334 and relative to the base 332. The motor plate 222 and/or the intermediate supports 224 may engage with the second segment 336 of the third bracket 324.

In this way, the inlet panel 180 and the third bracket 324 may capture opposite sides of the fan assembly 210 positioned in engagement with the track 298, thereby blocking movement of the fan assembly 210 in directions 338 (e.g., longitudinal directions) relative to the fan deck 174 and/or relative to the enclosure 178. Additionally, the fan assembly 210 may rest on the first bracket 320 and/or on the second bracket 322. The fan assembly 210 may slide along the track 298 to adjust the fan assembly 210 to a desirable position. For example, the fan assembly 210 may be translated to align openings of the inlet plate 220 with corresponding openings of the inlet panel 180, and the first fasteners 280 may be inserted through the aligned openings to secure the inlet panel 180 and the inlet plate 220 to one another. Additionally or alternatively, the fan assembly 210 may be moved to enable the motor plate 222 and/or the intermediate supports 224 to couple to the second segment 336, such as via fasteners. In further embodiments, the inlet panel 180, the motor plate 222, and/or the intermediate supports 224 may couple to the first bracket 320 (e.g., the flange 330) and/or to the second bracket 322 (e.g., to the base 332).

Figure 10:
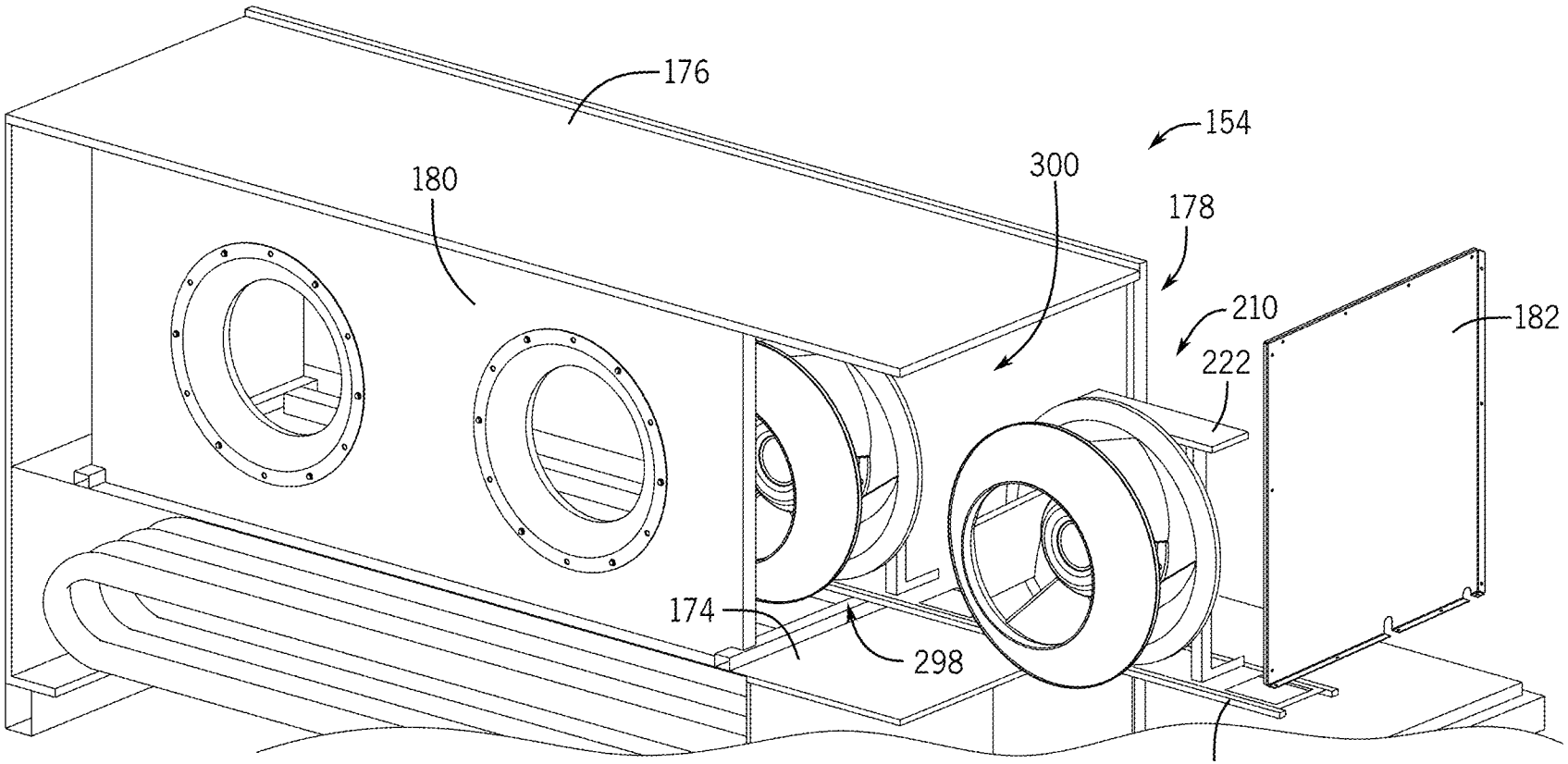
FIG. 10 is a front exploded perspective view of an embodiment of a fan section of an HVAC system with a fan assembly configured to move along a track of the fan section, in accordance with an aspect of the present disclosure.

FIG. 10 is a front exploded perspective view of an embodiment of the fan section 154 in which each fan assembly 210 may be configured to move along the inlet panel 180 and/or the fan deck 174. In the illustrated embodiment, each fan assembly 210 (e.g., the motor plate 222) may be coupled to a common support 340, and the common support 340 may be configured to move, such as translate, along the track 298 defined by the enclosure 178. For example, each fan assembly 210 may be fixedly coupled to the support 340 to enable movement of the support 340 to simultaneously move each of the fan assemblies 210 with respect to the enclosure 178. Thus, movement of the support 340 may enable the fan assemblies 210 to be removed from the volume 300 of the enclosure 178 and/or inserted into the volume 300 of the enclosure 178 in conjunction with one another.

Figure 11:
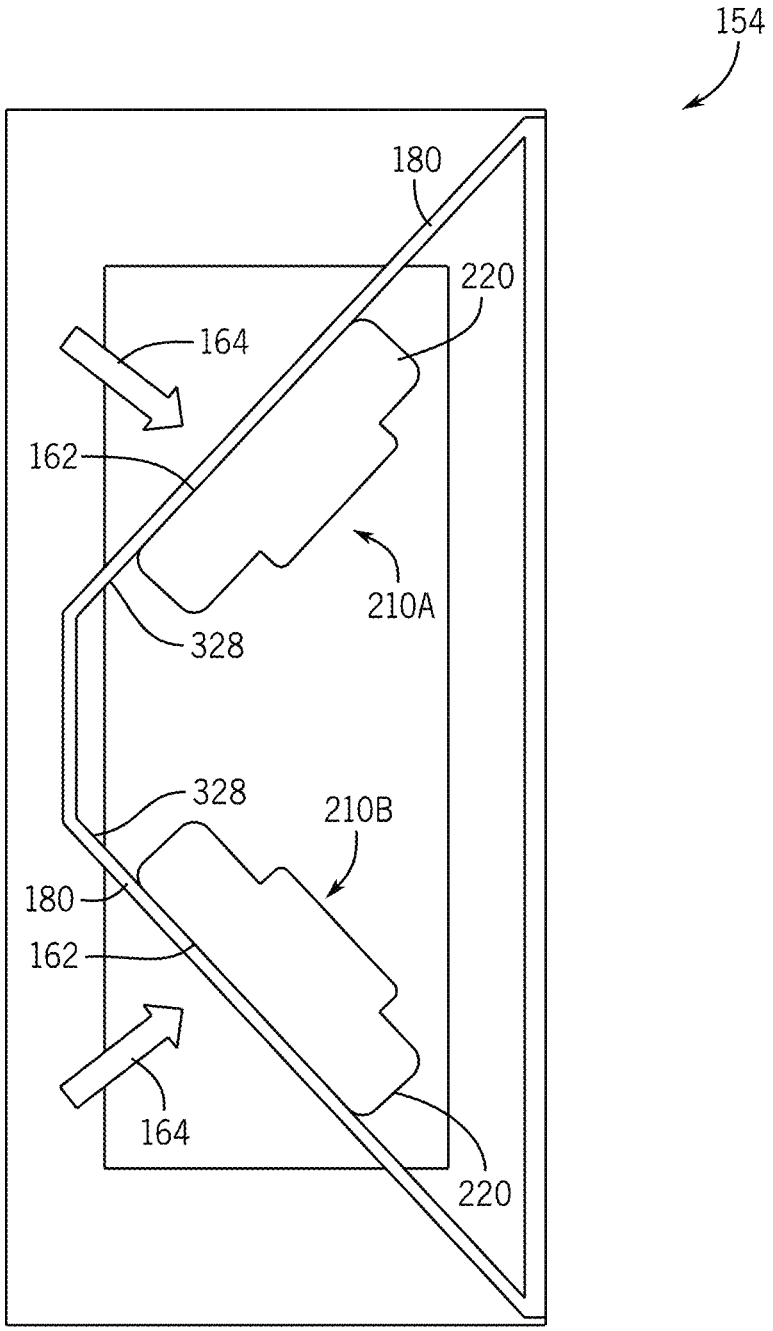
FIG. 11 is a schematic diagram illustrating a top view of an embodiment of a fan section configured to direct an air flow through an HVAC system, in accordance with an aspect of the present disclosure.

FIG. 11 is a schematic diagram illustrating a top view of an embodiment of the fan section 154 that includes a first fan assembly 210A and a second fan assembly 210B. The respective inlets 162 of the fan assemblies 210 may face away from one another. To this end, the surfaces 328 to which the fan assemblies 210 are coupled may be oriented obliquely relative to one another and may face one another. As such, the respective inlet plates 220 of the fan assemblies 210 coupled to the surfaces 328 may also be oriented obliquely relative to one another. In this manner, the respective first directions 164 in which the fan assemblies 210 direct air flow into the fan section 154 may converge toward one another within the fan section 154.

In some embodiments, the surfaces 328 may be of different inlet panels 180. That is, the fan assemblies 210 may be coupled to separate inlet panels 180 that are oriented obliquely relative to one another. In additional or alternative embodiments, the surfaces 328 may be of the same inlet panel 180. As an example, the inlet panel 180 may be bent to form the surfaces 328 that extend obliquely relative to one another and face one another. As such, the fan assemblies 210 may be coupled to a common inlet panel 180.

Figure 12:
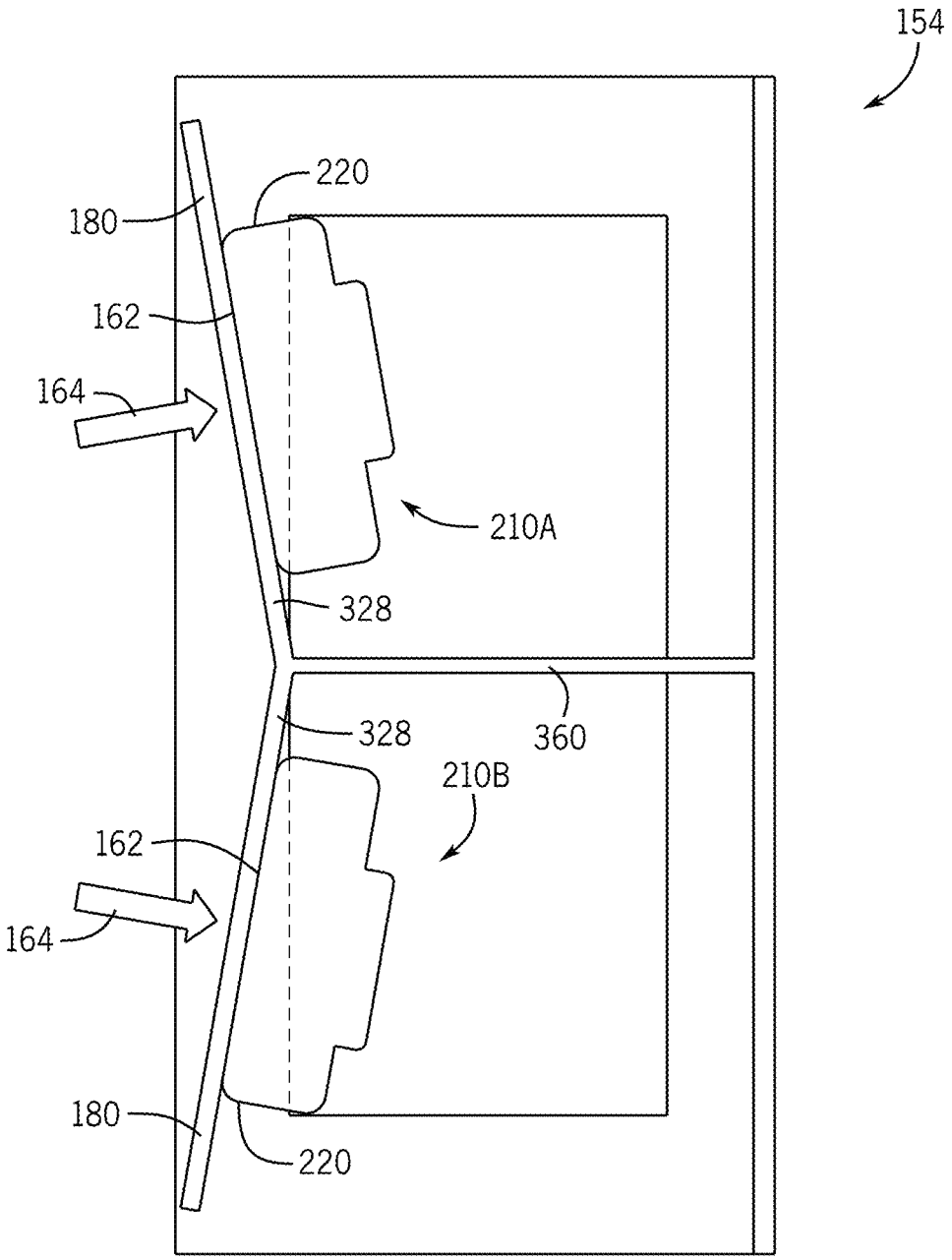
FIG. 12 is a schematic diagram illustrating a top view of an embodiment of a fan section configured to direct an air flow through an HVAC system, in accordance with an aspect of the present disclosure.

FIG. 12 is a schematic diagram illustrating a top view of an embodiment of the fan section 154 that includes the first fan assembly 210A and the second fan assembly 210B. The respective inlets 162 of the fan assemblies 210 may face toward one another. To this end, the surfaces 328 to which the fan assemblies 210 are coupled may be oriented obliquely relative to one another and may face away from one another. As such, the respective inlet plates 220 of the fan assemblies 210 coupled to the surfaces 328 may also be oriented obliquely relative to one another, and the respective first directions 164 in which the fan assemblies 210 direct air flow into the fan section 154 may diverge away from one another within the fan section 154.

The surfaces 328 may be of different inlet panels 180 or of the same inlet panel 180. Additionally, a divider panel 360 may be positioned within the fan section 154. The divider panel 360 may facilitate air flow into the heat exchange section 156. By way of example, without the divider panel 360, the respective air flows directed by the fan assemblies 210 may mix within the fan section 154, and mixture of the air flows may disrupt flow of air from the fan section 154 into the heat exchange section 156. The divider panel 360 may block mixture of the air flows and, instead, direct the air flows from the fan section 154 into the heat exchange section 156.

Figure 13:
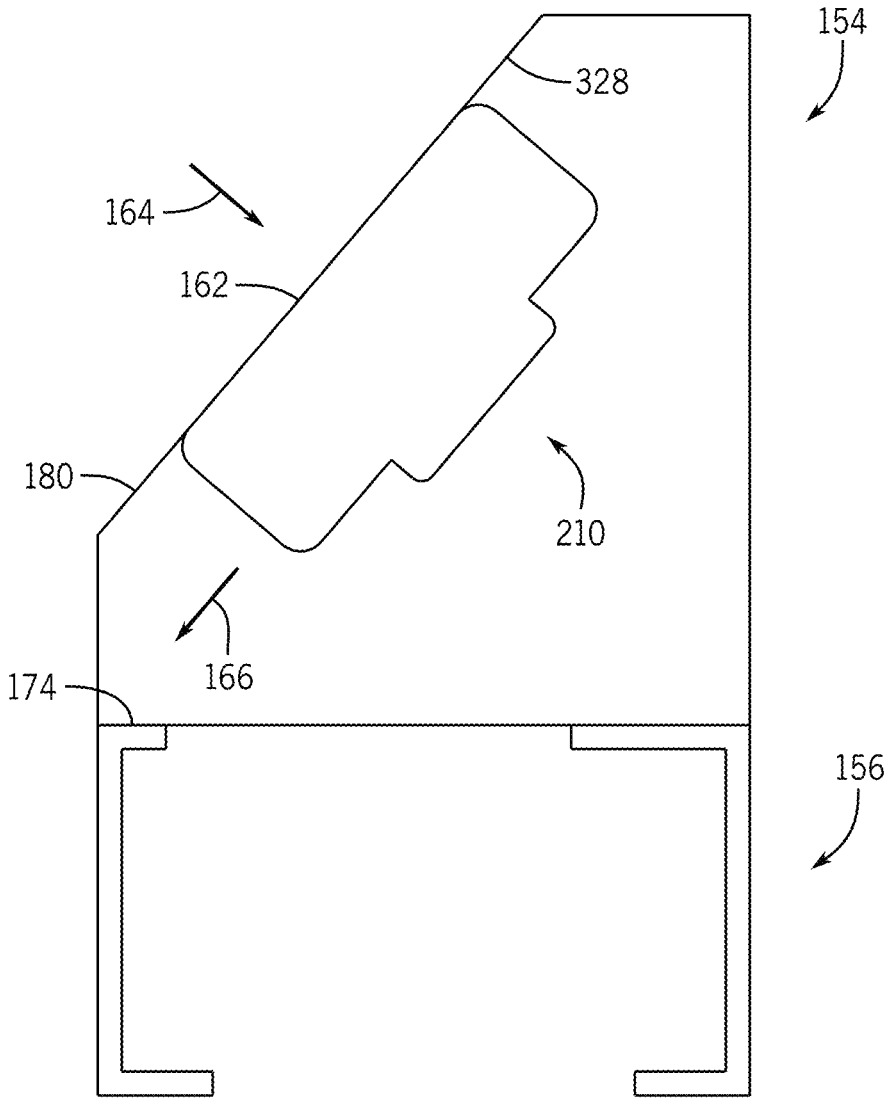
FIG. 13 is a schematic diagram illustrating a side view of an embodiment of a fan section and a heat exchange section of an HVAC system, in accordance with an aspect of the present disclosure.

FIG. 13 is a schematic diagram illustrating a side view of an embodiment of the fan section 154 and the heat exchange section 156. In the illustrated embodiment, the surface 328 of the inlet panel 180 may be oriented obliquely relative to a direction in which the fan deck 174 extends across the fan section 154 and/or across the heat exchange section 156 (e.g., crosswise to a direction in which the fan section 154 and the heat exchange section 156 are positioned adjacent to or against one another). As such, the first direction 164 in which air flow is directed into the fan section 154 via the fan assembly 210 may be oriented obliquely with respect to the direction in which the fan deck 174 extends across the fan section 154 and/or across the heat exchange section 156. For this reason, the second direction 166 in which the fan assembly 210 directs air flow into the heat exchange section 156 may be oriented obliquely with respect to the direction in which the fan deck 174 extends across the fan section 154 and/or across the heat exchange section 156. As an example, the fan assembly 210 may be oriented to direct air flow in the first direction 164 (e.g., a partially downward direction) toward the heat exchange section 156. As another example, the fan assembly 210 may be oriented to direct air flow in the first direction 164 (e.g., a partially upward direction) away from the heat exchange section 156. Such orientation of the fan assembly 210 may adjust the direction in which air flows through the heat exchange section 156, such as across the heat exchanger 160 and/or for discharge out of the heat exchange section 156.

The present disclosure may provide one or more technical effects useful in the operation of an HVAC system. For example, the HVAC system may include a fan section and a fan assembly configured to be positioned within the fan section. During operation, the fan assembly may direct an air flow through the HVAC system, such as across a heat exchanger, to condition the air flow. The fan assembly may include a fan having an impeller that is directly coupled to a motor. Thus, rotation of the motor may directly cause rotation of the impeller. As such, the motor may efficiently drive rotation of the impeller (e.g., with reduced power loss) without usage of additional components to transfer power from the motor to rotate the impeller. Such coupling between the impeller and the motor may also reduce a complexity of the fan, thereby providing ease of installation, inspection, maintenance, replacement, and so forth of the fan. The fan may be coupled to a mount of the fan assembly, and the mount may be easily positioned in engagement with and/or removed from engagement with a track cooperatively defined by an enclosure and a fan deck of the fan section. For example, the mount may slide along the enclosure and/or along the fan deck to adjust a position of the fan relative to the fan section. Thus, ease of installation, inspection, maintenance, replacement, and so forth of the fan assembly may further be improved. The mount may be coupled to a panel of the enclosure to block relative movement between the fan assembly and the enclosure and/or between the fan assembly and the fan deck, thereby securing a position of the fan assembly within the fan section. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A heating, ventilation, and air conditioning (HVAC) system, comprising:

a fan deck and an enclosure cooperatively defining a track;

a fan configured to direct air flow through the HVAC system; and a mount positioned in engagement with the track and in the enclosure, wherein the mount is coupled to the fan and is configured to move along the track, thereby adjusting a position of the fan in the enclosure, wherein the enclosure comprises a panel, the mount comprises a plate, and the panel and the plate are configured to couple to one another to secure the position of the fan in the enclosure, wherein the fan comprises an inlet, and the inlet is configured to couple to the plate of the mount, wherein the fan is configured to draw the air flow into the enclosure along an axis of the panel, the plate, and the inlet.

2. The HVAC system of claim 1, wherein the fan comprises an impeller and a motor, the impeller and the motor are directly coupled to one another, and the motor is configured to drive rotation of the impeller to direct air flow through the HVAC system.

3. The HVAC system of claim 2, wherein the motor is an electronically commutated motor.

4. The HVAC system of claim 2, wherein the impeller comprises blades that extend opposite to a direction of the rotation of the impeller driven by the motor.

5. The HVAC system of claim 1, comprising a heat exchanger, wherein the fan is configured to direct air flow across the heat exchanger.

6. A fan section of a heating, ventilation, and air conditioning (HVAC) system, comprising:

a fan assembly comprising a plate and a fan coupled to the plate;

an enclosure comprising a panel; and a fan deck comprising a bracket, wherein the plate of the fan assembly engages with the bracket of the fan deck and the panel of the enclosure in an installed configuration of the fan assembly, wherein the plate is a first plate, the fan comprises an inlet coupled to the first plate, and the fan assembly comprises a second plate coupled to a motor, wherein the first plate is coupled to the panel such that the fan assembly is configured to draw an air flow into the enclosure along an axis of the panel, the first plate, and the inlet.

7. The fan section of claim 6, wherein the fan comprises a direct drive fan having the motor directly coupled to an impeller.

8. The fan section of claim 7, wherein the bracket of the fan deck is a first bracket, the fan deck comprises a second bracket, and the second plate of the fan assembly engages with the second bracket in the installed configuration of the fan assembly.

9. The fan section of claim 8, wherein the fan deck comprises a third bracket that includes a first segment and a second segment extending crosswise to one another, the first segment is coupled to a base of the second bracket, and the second plate of the fan assembly engages with the base of the second bracket and the second segment of the third bracket in the installed configuration of the fan assembly.

10. The fan section of claim 7, comprising an intermediate support coupled to the first plate and to the second plate.

11. The fan section of claim 6, wherein the bracket of the fan deck comprises a flange that extends crosswise to a surface of the panel of the enclosure, and the plate of the fan assembly engages with the flange of the bracket and the surface of the panel in the installed configuration of the fan assembly.

12. A heating, ventilation, and air conditioning (HVAC) system, comprising:

a fan deck;

an enclosure comprising a panel coupled to the fan deck; and a fan assembly comprising a mount and an inlet of a fan coupled to the mount, wherein the mount is configured to engage with the fan deck and the panel of the enclosure in an installed configuration of the fan assembly to enable an air flow into the enclosure along an axis of the mount, the panel, and the inlet, and the mount is configured to slide along the fan deck and the enclosure.

13. The HVAC system of claim 12, wherein the mount is configured to couple to the panel of the enclosure to block relative movement between the mount and the enclosure and between the mount and the fan deck.

14. The HVAC system of claim 12, wherein the enclosure comprises an additional panel coupled to the fan deck, the panel and the additional panel are oriented obliquely relative to one another, the HVAC system comprises an additional fan assembly comprising an additional mount and an additional fan coupled to the additional mount, and the additional mount is configured to engage with the fan deck and the additional panel of the enclosure in an installed configuration of the additional fan assembly.

15. The HVAC system of claim 14, wherein the mount is configured to engage with a first surface of the panel in the installed configuration of the fan assembly, the additional mount is configured to engage with a second surface of the additional panel in the installed configuration of the additional fan assembly, and the first surface and the second surface face toward one another.

16. The HVAC system of claim 12, wherein the fan comprises an impeller, and a motor is directly coupled to the impeller.

17. The HVAC system of claim 12, wherein the enclosure comprises an additional panel coupled to the panel and to the fan deck, wherein the panel, the additional panel, and the fan deck define a volume of the enclosure, and the fan assembly is positioned within the volume in the installed configuration of the fan assembly.

* * * * *